US010378278B2

(12) United States Patent
Tang

(10) Patent No.: US 10,378,278 B2
(45) Date of Patent: Aug. 13, 2019

(54) SMART LADDER

(71) Applicant: Sentron Engineering (S) Pte Ltd, Singapore (SG)

(72) Inventor: Heng Hung Tang, Singapore (SG)

(73) Assignee: Sentron Engineering (S) Pte Ltd, Singapore (SG)

( * ) Notice: Subject to any disclaimer, the term of this patent is extended or adjusted under 35 U.S.C. 154(b) by 36 days.

(21) Appl. No.: 15/508,931

(22) PCT Filed: Jan. 27, 2017

(86) PCT No.: PCT/SG2017/050044

§ 371 (c)(1),
(2) Date: Mar. 6, 2017

(87) PCT Pub. No.: WO2017/131589

PCT Pub. Date: Aug. 3, 2017

(65) Prior Publication Data

US 2018/0112464 A1 Apr. 26, 2018

Related U.S. Application Data

(60) Provisional application No. 62/287,912, filed on Jan. 28, 2016.

(51) Int. Cl.

| | |
|---|---|
| ***E06C 1/20*** | (2006.01) |
| ***E06C 1/18*** | (2006.01) |
| ***E06C 1/393*** | (2006.01) |
| ***E06C 7/00*** | (2006.01) |
| ***E06C 7/42*** | (2006.01) |
| ***E06C 7/50*** | (2006.01) |

(52) U.S. Cl.
CPC ..... *E06C 1/20* (2013.01); *E06C 1/18* (2013.01); *E06C 1/393* (2013.01); *E06C 7/003* (2013.01); *E06C 7/423* (2013.01); *E06C 7/50* (2013.01)

(58) Field of Classification Search
CPC ..... E06C 7/003
See application file for complete search history.

(56) References Cited

U.S. PATENT DOCUMENTS 4,641,729 A * 2/1987 Beck ..... E06C 1/22 182/172
4,798,262 A 1/1989 Margolies
(Continued)

FOREIGN PATENT DOCUMENTS

FR 2554501 A1 * 5/1985 ..... E06C 1/20

*Primary Examiner* — Alvin C Chin-Shue
(74) *Attorney, Agent, or Firm* — Horizon IP Pte Ltd.

(57) ABSTRACT

Disclosed is a smart ladder. The smart ladder may be A-frame type of ladders, such as A-frame ladders and A-frame platform ladders. The smart ladder includes right and left outrigger leg units which are swiveled coupled to the right and left sides of the ladder to provide side support. The ladder includes brace units facilitate in folding and unfolding of the ladder as well as the outrigger legs. An electronic system, which includes a sensor network, a processor and a warning system, is provided. The sensor network senses side inclination angle of the ladder and side force on the outriggers and predict potential hazards from exceeding load and angle thresholds. This enhances safe operation of the ladder and avoids injuries to the user and others in the vicinity.

14 Claims, 20 Drawing Sheets

(56) References Cited

U.S. PATENT DOCUMENTS

| | | | | |
|---|---|---|---|---|
| 4,872,529 | A | 10/1989 | Viets | |
| 7,017,711 | B1 | 3/2006 | Ali | |
| 8,616,334 | B2 * | 12/2013 | Allred | E06C 1/39 182/106 |
| 2002/0074187 | A1 * | 6/2002 | Bendle | E06C 1/22 182/172 |
| 2005/0173189 | A1 * | 8/2005 | Berardi | E06C 7/003 182/18 |
| 2006/0032704 | A1 * | 2/2006 | Chandra | E06C 7/003 182/18 |
| 2010/0031573 | A1 * | 2/2010 | Whiting | E05B 47/02 49/31 |
| 2013/0113617 | A1 * | 5/2013 | Wang | E06C 7/003 340/521 |

* cited by examiner

100

110

200

184

210

SMART LADDER

CROSS-REFERENCE TO RELATED APPLICATIONS

This application claims the priority of PCT Application No. PCT/SG2017/050044 entitled "Smart Ladder" filed on Jan. 27, 2017, which claims priority to U.S. Provisional Application No. 62/287,912, entitled "Smart Ladder with Leveling Warning and Fall-Prevention System" filed on Jan. 28, 2016. Both of which are herein incorporated by reference in its entirety.

BACKGROUND

Ladders are widely used to provide access to high places which a person can't reach. When using a ladder, various hazards can occur. For example, a user may reach over the side of the ladder to access an item. Reaching over the side may cause conventional ladders to tip over. In addition, a user may be carrying tools while using a ladder. The additional load may exceed load limits of the ladder without the user's knowledge. Exceeding load limits may cause the ladder to collapse. These various scenarios may cause serious injuries to users of the ladder as well as to others who are in the vicinity.

The disclosure is directed to A-frame type ladder, including A-frame and A-frame platform ladders, which includes modular mechanical and electronic components to expand stability and safety of the ladder.

SUMMARY

Embodiments of the present disclosure generally relates to smart ladders. In one embodiment, a ladder is disclosed. A ladder includes a front rail unit which includes a plurality of steps. Rear rail units are provided and are coupled to form an A-frame type ladder. A right outrigger leg unit is coupled to a right side of the ladder and is configured to provide lateral support on the right side of the ladder. A left outrigger leg unit is coupled to a left side of the ladder and is configured to provide lateral support on the left side of the ladder. A right brace unit is coupled to the right side of the ladder and right outrigger leg units; and a left brace unit is coupled to the left side of the ladder and left outrigger leg units. The right and left brace units guide the folding and unfolding of the ladder, which the right brace unit guides the folding and unfolding of the right outrigger leg unit, and the left brace unit guides the folding and unfolding of the left outrigger leg unit.

These and other objects, along with advantages and features of the present invention herein disclosed, will become apparent through reference to the following description and the accompanying drawings. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Embodiments generally relate to smart ladders. The ladders may be A-frame type of ladders. For example, ladders may be A-frame ladders or A-frame platform ladders. Other types of ladders may also be used. The smart ladders, for example, include control unit and various types of sensors to facilitate their safe use. The smart ladders may be employed in a construction environment. Employing the smart ladders in other environments, such as commercial or non-commercial environments may also be useful.

Figure 1A:
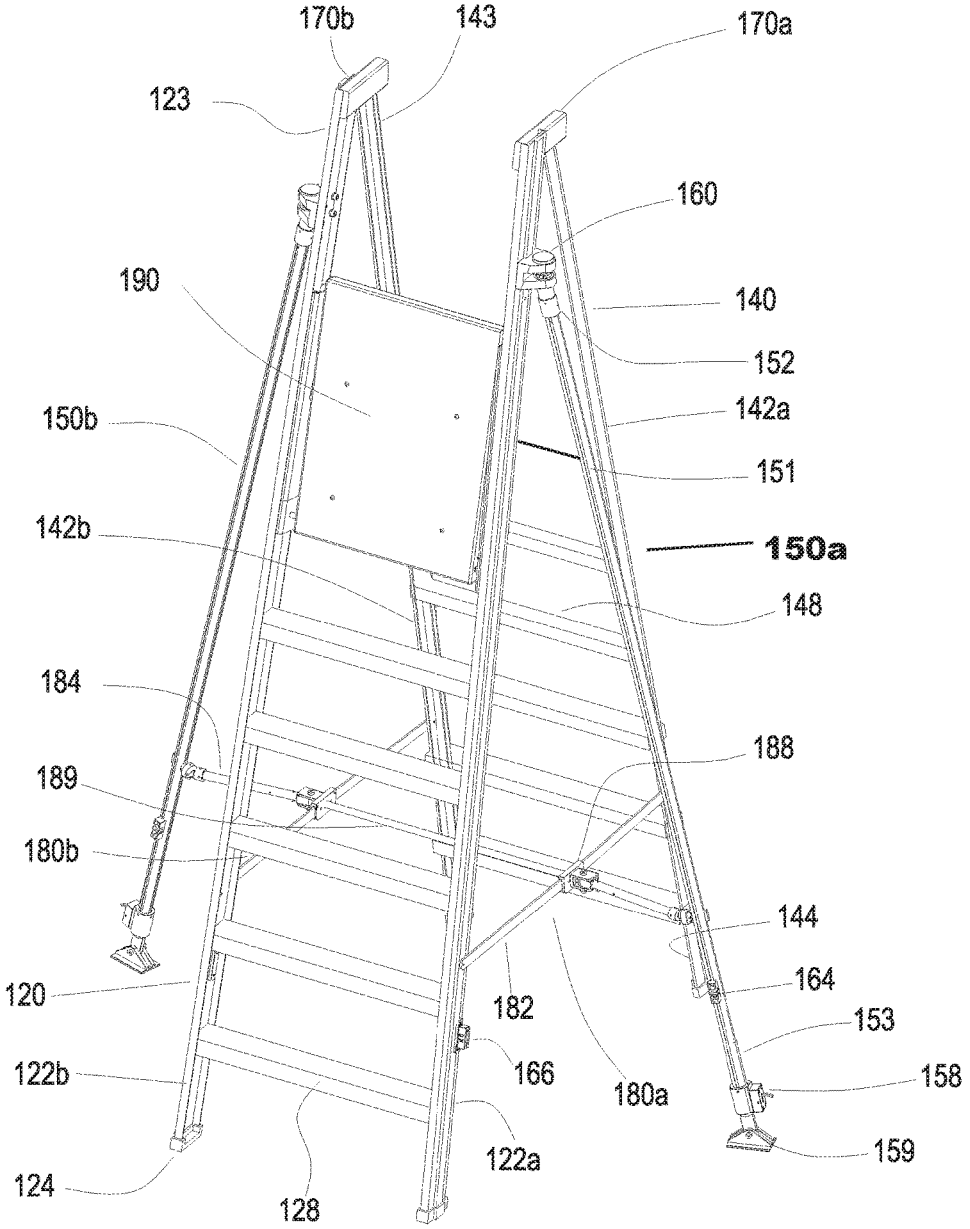
FIGS. 1*a-d* show different embodiments of A-frame type ladders.
Figure 1B:
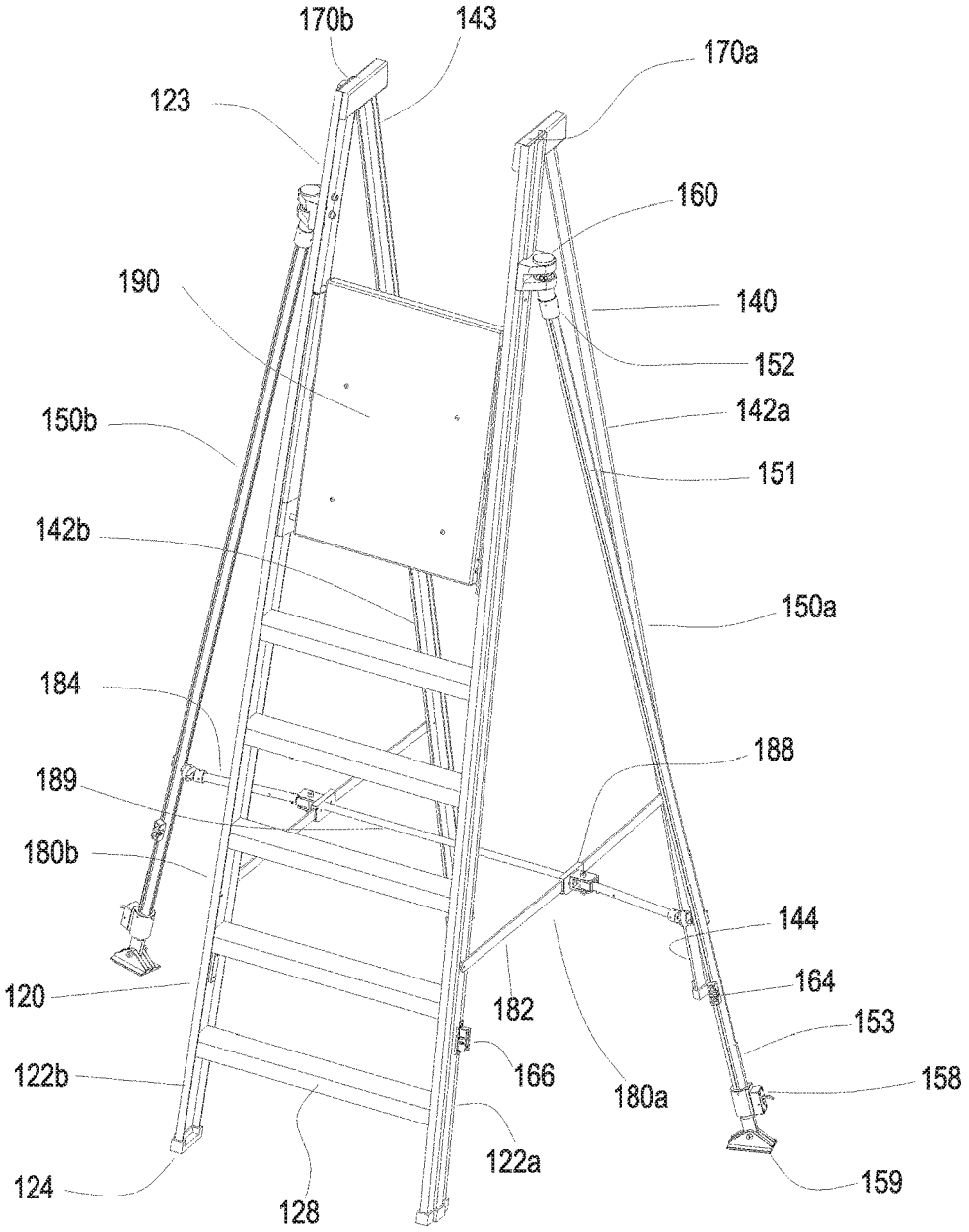

FIGS. 1*a-b* show exemplary embodiments of A-frame ladders 100 and 110. Referring to FIGS. 1*a-b*, the ladder includes first and second rail units 120 and 140. The first rail unit, for example, may be referred to as a front rail unit and the second unit may be referred to as a rear rail unit. The first or front rail unit includes right and left front rails 122*a-b*. A front rail includes a first and second ends 123 and 124. The first end may be the top end and the second end may be the bottom end. For example, the top ends of the front rails form a top end of the front rail unit; the bottom ends of the front rails form a bottom end of the front rail unit. The front rail unit includes steps 128 coupled to the right and left front rails. The steps are spaced apart along the rail unit to enable a user to go up and down the ladder. The steps, for example, should comply with industry standards, such as European standards BS EN 131-1:2007+A1:2011 and BS EN 131-2:2010+A1:2012. Complying with other industry standards, such as occupational safety and health administration (OSHA) standards and US accredited standards committee (ASC) A14 ladder safety standards may also be useful.

The second or rear rail unit includes right and left rear rails 142*a-b*. A rear rail includes a first and second ends 143 and 144. The first end may be the top end and the second end may be the bottom end. For example, the top ends of the rear rails form a top end of the rear rail unit; the bottom ends of the rear rails form a bottom end of the rear rail unit. The rear rail unit may include steps 148 coupled to the right and left rear rails, as shown in FIG. 1*a*. The steps, for example, are spaced apart along the rail unit to enable a user to climb up and down the ladder. In other embodiments, the rear rails may be individual rails without steps, as shown in FIG. 1B. Other configurations of rear rails may also be useful. For example, one or more cross-supports may be provided. The cross-supports may provide additional structural support for the rear rail unit. The cross-supports may have a Z-configuration or other arrangements to create additional structural supports.

A ladder limiting panel 190 may be provided for the ladder. The ladder limiting panel serves as a panel to ensure that a user is aware of the maximum height it has reached with the step below as the maximum allowable height limit.

The top ends of the front and rear rail units 123 and 143 are connectively coupled by rail couplers 170*a-b*, enabling the bottom ends of the front and rear rail units to swing towards or away from each other. For example, the rail units may be folded by swinging the bottom ends towards each other and unfolded by swinging the bottom ends away from each other. The angle formed by swinging the bottom ends of the rail unit is the rail swing angle. The rail units are configured to have a maximum rail swing angle which provides optimum expanded or unfolded stability envelope. The maximum rail swing angle should comply with industry standards. In one embodiment, a right and left rail coupler 170*a-b* are provided to couple the front and rear rail units. The right rail coupler couples first or top ends of the front and rear right rails; the left rail coupler couples first or top ends of the front and rear left rails. As shown, the rail couplers are individual rail couplers. In some embodiments, the rail couplers may be integrated into a top step of the ladder. Other configurations of couplers may also be useful.

In one embodiment, right and left outrigger leg units 150*a-b* are provided. An outrigger unit includes, for example, an elongated outrigger member 151 having a top end 152 and a bottom end 153. The bottom end includes an adjustable foot module 158. The adjustable foot module includes a foot 159 which may be fitted with an anti-slip pad. The angle of the foot may be adjustable. The angle of the foot, in the standing position, pivots on around axis on the x-y plane, which is parallel to the ground. In addition, the adjustable foot unit adjusts the length of the outrigger unit.

The top end of the outrigger module includes an outrigger coupling unit 160. For example, the top end of the outrigger member is coupled to the outrigger coupling unit. The coupling unit is mounted onto the side of a rail unit. In one embodiment, the coupling unit is mounted onto the side of the front rail. For example, the right outrigger unit is coupled to the right rail of the front rail unit by the coupling unit and the left outrigger unit is coupled to the left rail of the front rail unit by the coupling unit. Coupling the outrigger module to the rear rail may also be useful. Other configurations of coupling the outrigger modules to the sides of the ladder may also be useful.

The coupling unit is mounted onto an upper portion of a side of a ladder, coupling the outrigger unit thereto. The position of the coupling unit is selected to produce the maximum stability. The selected position may depend on the height of the ladder. The length of the outrigger unit may be equal to about the length of the front rail minus the distance of the coupling point from the top of the front rail. As discussed, the adjustable foot module may adjust the length of the outrigger unit by, for example, about ±10-20%. Adjusting the length of the outrigger unit by other percentage may also be useful.

A storage lock unit is provided on the outrigger unit and the front rail unit. The storage lock unit includes first and second storage lock sub-units 164 and 166. The first storage lock sub-unit is disposed on the outrigger unit while the second storage lock sub-unit is disposed on the front rail. The first and second storage lock sub-units are mated to lock the outrigger unit in position when it is in the folded position.

The coupling unit, in one embodiment, includes a swivel joint coupling unit. The swivel joint coupling unit enables an outrigger unit to swivel about the side of a ladder. For example, the outrigger unit rotates or swivels about an axis of rotation of the coupling unit. In one embodiment, the coupling unit is configured such that the outrigger unit rotates about its vertical axis of rotation. The vertical axis, for example, is the z-axis when the ladder is standing on the ground when unfolded. In one embodiment, the outrigger coupling unit includes a swivel joint assembly. The swivel joint assembly may be a bearing swivel joint assembly. The bearing may be a ball bearing. Other types of bearings, such as sleeve bearings, may also be useful.

An outrigger unit swivels between a first or folded and a second or unfolded position. In the folded position, the outrigger unit is disposed adjacent and parallel to side of the rail to which it is coupled. For example, the outrigger unit is disposed adjacent to the side of the front rail. In the unfolded position, the outrigger unit is swiveled at an outrigger swivel angle that should provide maximum extended overall stability envelop to the side of the ladder. In one embodiment, the outrigger unit is configured to be automatically locked when it reaches its unfolded position. The unfolded position should produce maximum lateral stability.

In one embodiment, the outrigger coupling unit and the outrigger unit are configured to produce a single fan-shaped folding/unfolding profile from the folded to the unfolded position. For example, the outrigger unit is disposed at a designated angle with respect to the rotation of the swivel joint assembly. The designated angle, for example, results in outrigger unit to be parallel to the front rail when in the folded position and have an outrigger swing angle to provide lateral stability in the unfolded position. In one embodiment, the outrigger swing angle provides maximum lateral stability in the unfolded position.

As discussed, in the unfolded position, the outrigger unit is locked in its optimum angle that produce a maximum expanded stability envelop. The outrigger swing angle may be equal to the angle of the outrigger unit with respect to the z-axis (vertical axis). In one embodiment, the outrigger swing angel is about half of the rail swing angle. This enables the single fan shape folding/unfolding profile. Other configurations of the outrigger unit and outrigger coupling unit may also be useful. For example, the outrigger unit may be freely rotatably coupled to the coupling unit, such as with a ball joint assembly. This provides flexibility between the folded angle and the unfolded angle of the outrigger unit.

Right and left brace units 180*a-b* are provided. The right brace unit is provided for the right side of the ladder and the left brace unit is provided for the left side of the ladder. A brace unit includes a side rail brace module 182, an outrigger brace module 184 and a brace coupler module 188. The brace units are configured to guide the folding and unfolding of rail units and outrigger units.

In one embodiment, a side rail brace module 182 includes front and rear side brace members. A side brace member includes first and second ends. In one embodiment, a first end of the front side brace member is coupled to the side of the front rail, a first end of the rear side brace member is coupled to the side of the rear rail. In one embodiment, the first ends of the side brace members are rotatably coupled to the rails. The side brace members rotate around an axis which is perpendicular to the length direction of the rail. Second ends of the front side brace member and rear side brace member are commonly coupled to the brace coupler module.

The side brace modules are configured to guide the folding and unfolding of the ladder into its folded and unfolded position. In the folded position, the rails of the ladder are disposed adjacent to each other. In the unfolded position, as shown, the bottom ends of the rails are swung apart to the maximum rail swing angle. The side brace modules prevent inadvertent folding of the ladder when the ladder is unfolded.

As for the outrigger brace module 184, it includes an extendable brace member. The extendable brace member includes first and second outrigger brace sub-members. The first outrigger brace sub-member forms the first end of the extendable brace member and the second outrigger brace sub-member forms the second end of the extendable brace member. The first and second outrigger brace sub-members are slidably coupled. For example, the first outrigger brace sub-member is a hollow member in which the second outrigger brace sub-member is inserted. In one embodiment, the first outrigger brace sub-member is a hollow rod and the second outrigger brace sub-member is a rod. In one embodiment, the second outrigger brace sub-member is a solid rod. An inner diameter of the first outrigger brace sub-member is sufficient to accommodate the first outrigger brace sub-member.

The length of the outrigger brace module can be adjusted by sliding the first outrigger brace sub-member towards or away from the second outrigger brace sub-member. A length lock may be provided to prevent extension or contraction of the extendable outrigger brace member. The length lock, for example, may be a pin that is inserted through the first outrigger brace and sub-member module. The pin when engaged prevents the length of the extendable outrigger brace member from changing.

In one embodiment, the first end (first outrigger brace sub-member) of the extendable outrigger member is coupled to the outrigger unit with a ball joint coupler. The ball joint coupler enables unlimited degrees of freedom for rotating the outrigger brace member with respect to the outrigger unit. As for the second end (second outrigger brace sub-member) of the outrigger unit, it is coupled to the brace coupler module.

The brace coupler module 188 includes an outrigger coupler. In one embodiment, the outrigger coupler is a rotatable bracket coupler. The rotatable coupler rotates in an axis which is parallel to the ground or that of the side brace members. In one embodiment, the rotatable couplers of the right and left brace units may be integrated. Integrating the rotatable couplers, for example, is achieved by a coupling rod 189 that extends from one brace unit to the other. In one embodiment, the second end is coupled to the rotatable bracket coupler. The second end swivels with respect to the rotational bracket coupler.

As discussed, the outrigger brace units guide the folding and unfolding of the outrigger units. For example, when the ladder is unfolded, an outrigger unit may be folded or unfolded. An outrigger unit may be folded or unfolded one at a time. To unfold an outrigger unit, it is first disengaged from its storage lock. This enables the outrigger unit to be unfolded. The outrigger unit is then swung out to its unfolded position. The brace is configured to limit the unfolding of the outrigger unit to its maximum unfolded angle. The maximum unfolded angle should yield the maximum expanded stability. The outrigger brace unit is configured to lock the outrigger unit in place. After the outrigger unit is unfolded, the extendable outrigger brace member is locked, preventing its length from changing.

Figure 1C:
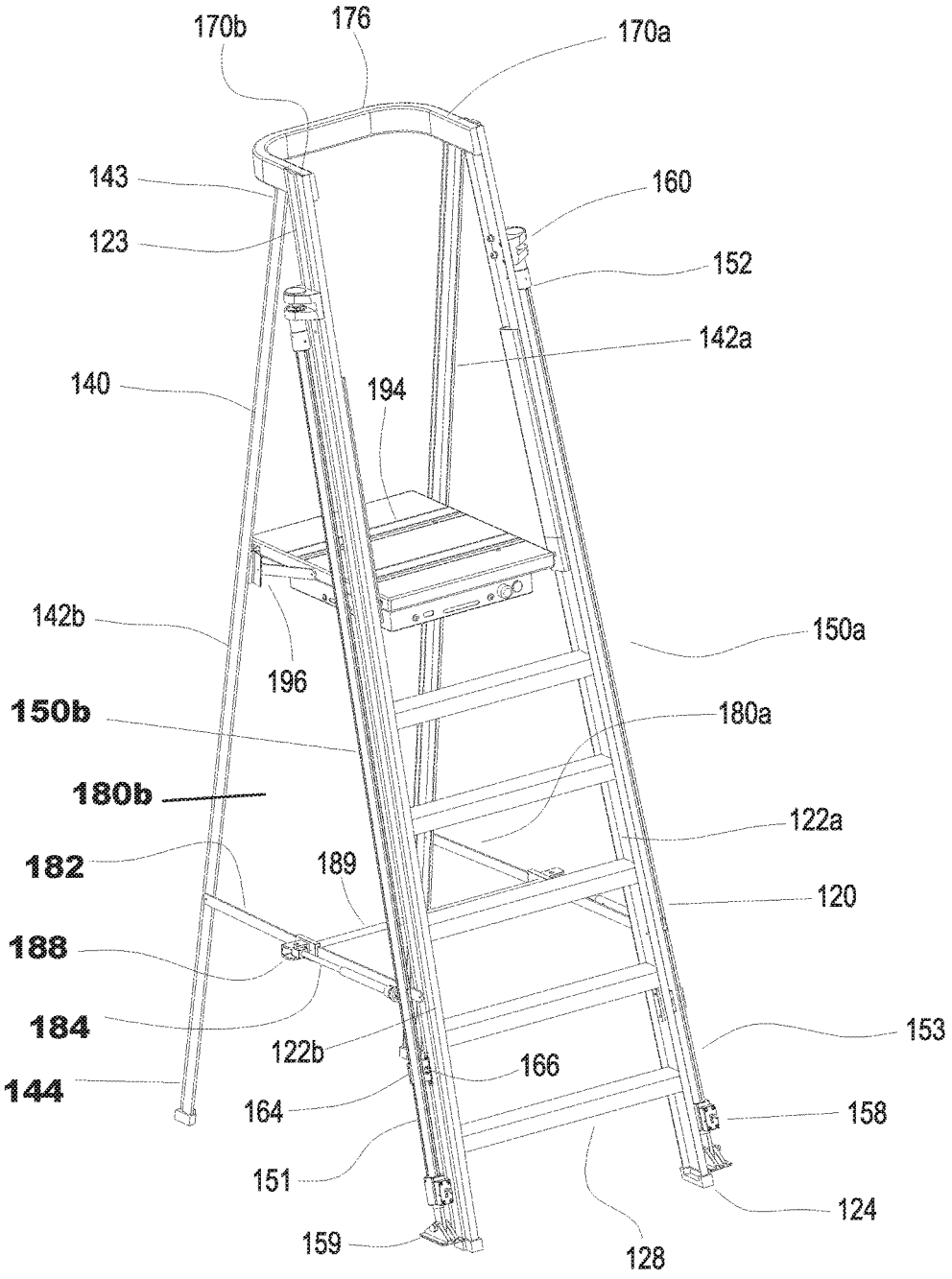
Figure 1D:
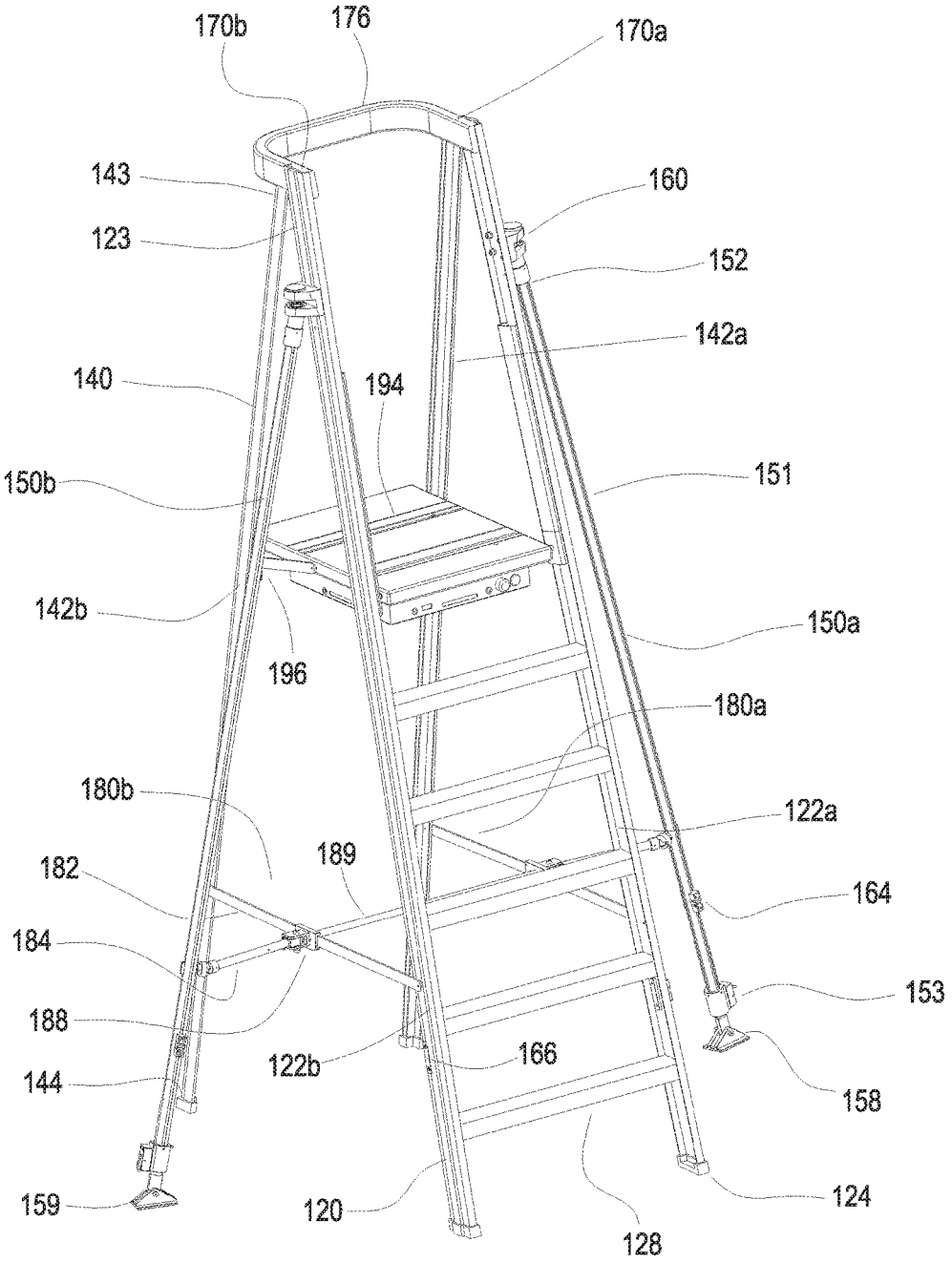

FIGS. 1*c-d* show embodiments of an A-frame platform ladder 200. The A-frame platform ladder is similar to the A-frame ladders of FIGS. 1*a-b*. Common elements may not be described or described in detail.

Referring to FIGS. 1*c-d*, the ladder includes first and second rail units 120 and 140. The top ends of the front rail units are connectively coupled by rail couplers 170*a-b*, enabling the bottom ends of the front and rear rail units to swing towards or away from each other. In one embodiment, right and left outrigger leg units 150*a-b* are provided. The right outrigger unit is coupled to the right side of the front rail unit and the left outrigger unit is coupled to the left side of the front rail unit. An outrigger unit is coupled to the rail unit by an outrigger coupling unit 160. A storage lock unit is provided on the outrigger unit and the front rail unit. The first and second lock sub-units are mated to lock the outrigger unit in position when it is in the folded position.

Right and left brace units 180*a-b* are provided on the right and left side of the ladder to facilitate folding and unfolding of rail units and outrigger units. For example, FIG. 1*c* shows the outrigger units in the folded position while FIG. 1*d* shows the outrigger units in the unfolded position. The folding/unfolding of the rail units and outrigger units is similar to that described for the A-frame ladder in FIGS. 1*a-b*.

In one embodiment, the ladder includes a platform 194. The platform is unfolded to be parallel to the x-y plane when the ladder is unfolded. The platform provides a surface on which a person can stand on. In one embodiment, the rail couplers are integrated to form a support rail 176. The support rail, for example, enables a person to hold onto it when standing on the platform, enhancing safety. In one embodiment, a front portion of the platform is rotatably coupled to the front rail unit. As for the back portion of the platform, it is coupled to the rear rail unit by a retractable platform brace 196. The platform brace enables the platform to retract in a folded position when the ladder is folded. For example, the platform may be parallel to the rail units of the folded ladder in a folded position. When the ladder is unfolded, the platform is extended to be parallel to the x-y plane, as shown in FIGS. 1*c-d*.

Although specific types of A-frame and A-frame platform ladders have been described, it is understood that other types of A-frame or A-frame platform ladders may also be employed. For example, any A-frame or A-frame ladders may be used and be equipped with outrigger units and outrigger brace units.

As described, the A-frame type ladders, such as the A-frame or A-frame platform ladders, include various mechanical components which form a mechanical system. For example, the A-frame type ladder is a mechanical system in which folding/unfolding of the rail units and outrigger units is performed manually. The various ladders are designed for a load rating 250 pounds or higher. In one embodiment, the various mechanical components are fabricated by lightweight aluminum or other types of metals. Fabricating the ladder using other materials may also be useful. The material of the mechanical components should be sufficient to satisfy the load rating of the ladder. The ladder complies with industry standards, such as BS EN 131-1:2007+A1:2011 and BS EN 131-2:2010+A1:2012 as well as OSHA and US A14 committee.

Figure 2:
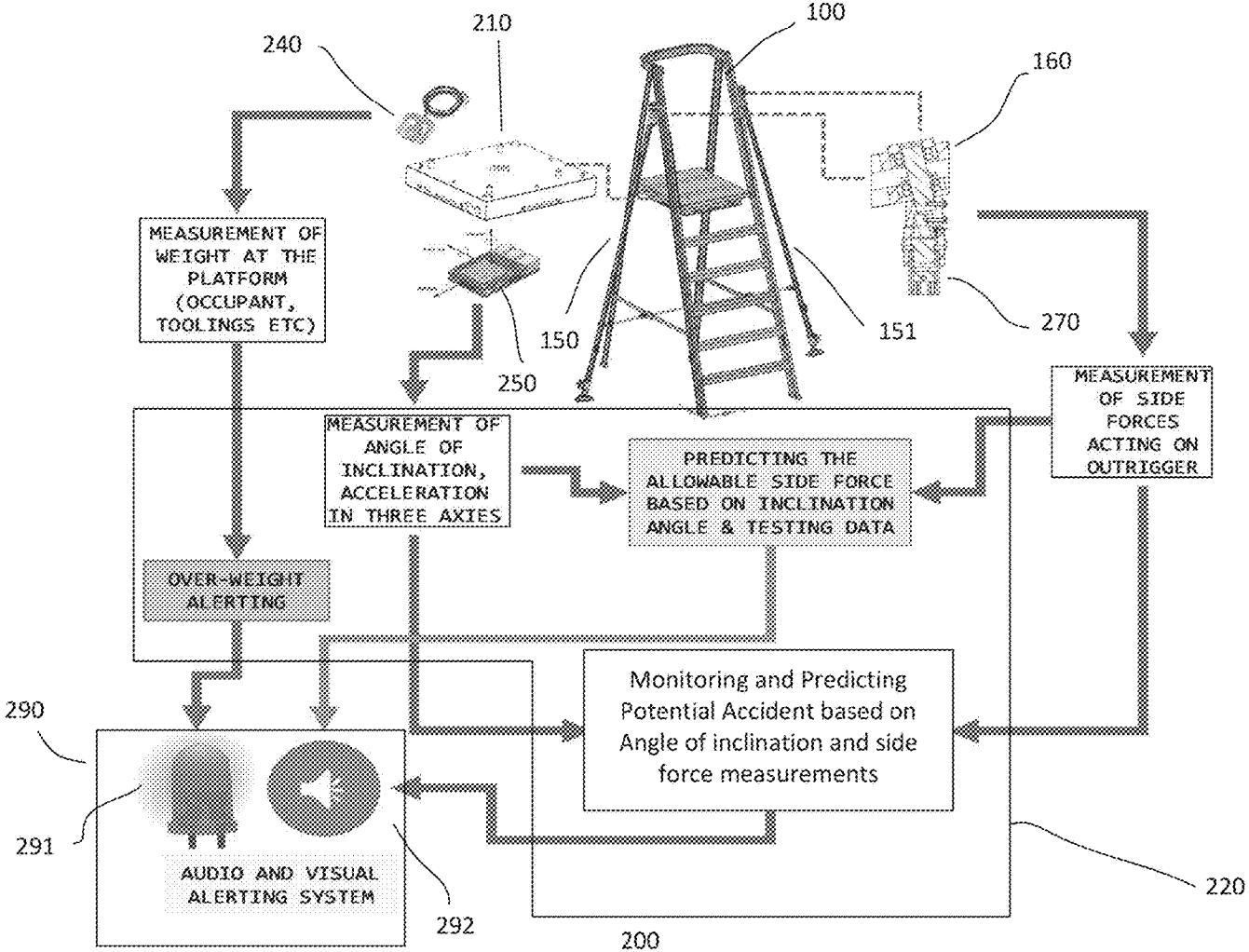
FIG. 2 shows an electronic system integrated into an A-frame type ladder.

FIG. 2 shows an embodiment of an A-frame type ladder 200 which includes its mechanical and electrical components. The electrical components form an electrical system of the ladder. For example, the ladder includes both mechanical and electrical systems. The various mechanical components of the mechanical system are similar to those described in FIGS. 1*a-d*. Common components may not be described or described in detail.

As for the electrical system, it includes a sensor network coupled to a processing unit. The electrical system enhances safety operation of the ladder. In one embodiment, the sensor network includes a side force sensing unit for sensing force asserted onto the outrigger units. The force sensing unit, for example, includes a force sensor for each outrigger unit 150. In one embodiment, the force sensor is a force sensing resistor. Other types of force sensors may also be useful. The force sensor, in one embodiment, is disposed in or integrated into a force sensor housing assembly 270 which is disposed between the outrigger coupler 160 and outrigger member 151. The force sensor measures the side loading on the force sensor housing assembly. The force sensors, for example, are coupled to the processing unit through wires. The wires, for example, should be weather or water proofed.

The sensor network includes an inertial measurement unit (IMU) 250. The IMU may be a microelectromechanical system (MEMS) sensor. The IMU sensor measures the angle of inclination and acceleration of the ladder in three axes. The output of the IMU sensor, for example, indicates the orientation of the ladder.

In one embodiment, the sensor network also includes a weight or load cell 210 for sensing load asserted on the ladder. For example, the load cell measures the weight on the platform of the ladder. For example, load cell sensors may be employed for platform ladders. The load cell may be a half bridge strain gauge. Other types of load cells may also be useful. In one embodiment, multiple load cells may be employed to measure strain on the platform. For example, the load cells may be arranged to measure strain at different parts of the platform to determine the load on the ladder. The sensor network may additionally include other types of sensors.

The various sensors are coupled to the processing unit 220. The processing unit includes, for example, a programmable microprocessor and memory. In one embodiment, the processing unit, load cell and IMU are integrated into an electronic module housing 210. In addition, an alarm unit 290 is integrated into the electronic module housing. In one embodiment, the alarm unit includes an audio alarm 291 and a visual alarm 292 for notifying a user of a potential problem. For example, the alarm unit notifies a user of a potential fall or excess load. In addition, the electronic module housing may include a work site safety warning alert system that alerts workers of the presence of a ladder at a work site as well as alerting the work site that someone is working on a ladder. Such warning system may be in the form of a visual alarm. The electronic module housing is mounted on the back side of the platform or A-ladder limiting panel of an A-frame type ladder.

Information from the sensor network is processed by the programmable microprocessor of the processing unit. In one embodiment, the microprocessor employs Kalman filtering or linear quadratic estimation (LQE) to process the sensor information. The Kalman filtering, for example, is used to predict anticipated side load and inclination angle from sensors data measured. The Kalman filtering also filters out electronic sensor noises to ensure a more reliable reading of data from the sensors. The microprocessor monitors and processes the sensor information, such as force on the outriggers and the inclination angle of the ladder. Using Kalman filtering, the microprocessor is able to predict a potential fall before it occurs based on the measured sensor data from the IMU sensor, force sensor and the allowable side force on the outrigger unit. In one embodiment, the microprocessor activates the alarm unit when a potential fall is predicted. In the event that the microprocessor detects a load which exceeds a threshold load limit, the alarm unit is activated. The alarm unit, in one embodiment, includes both audio and visual alarms. Both audio and visual alarms may be activated when a problem is predicted or detected.

In one embodiment, prediction is based on measured readings compared to test data. For example, testing on the ladder provides test data related to side force and inclination which can be sustained before falling or collapsing. Based on the test data, a model may be developed for which prediction is based on measured readings.

As described, the electrical system of the ladder serves as a warning system that a potential accident may occur prior to its occurrence. For example, information is processed to anticipate whether a fall may occur using predictive mathematical formulation, such as Kalman filtering or LQE. This improves safety by providing a warning when a potential fall is predicted or anticipated before it occurs.

Figure 3A:
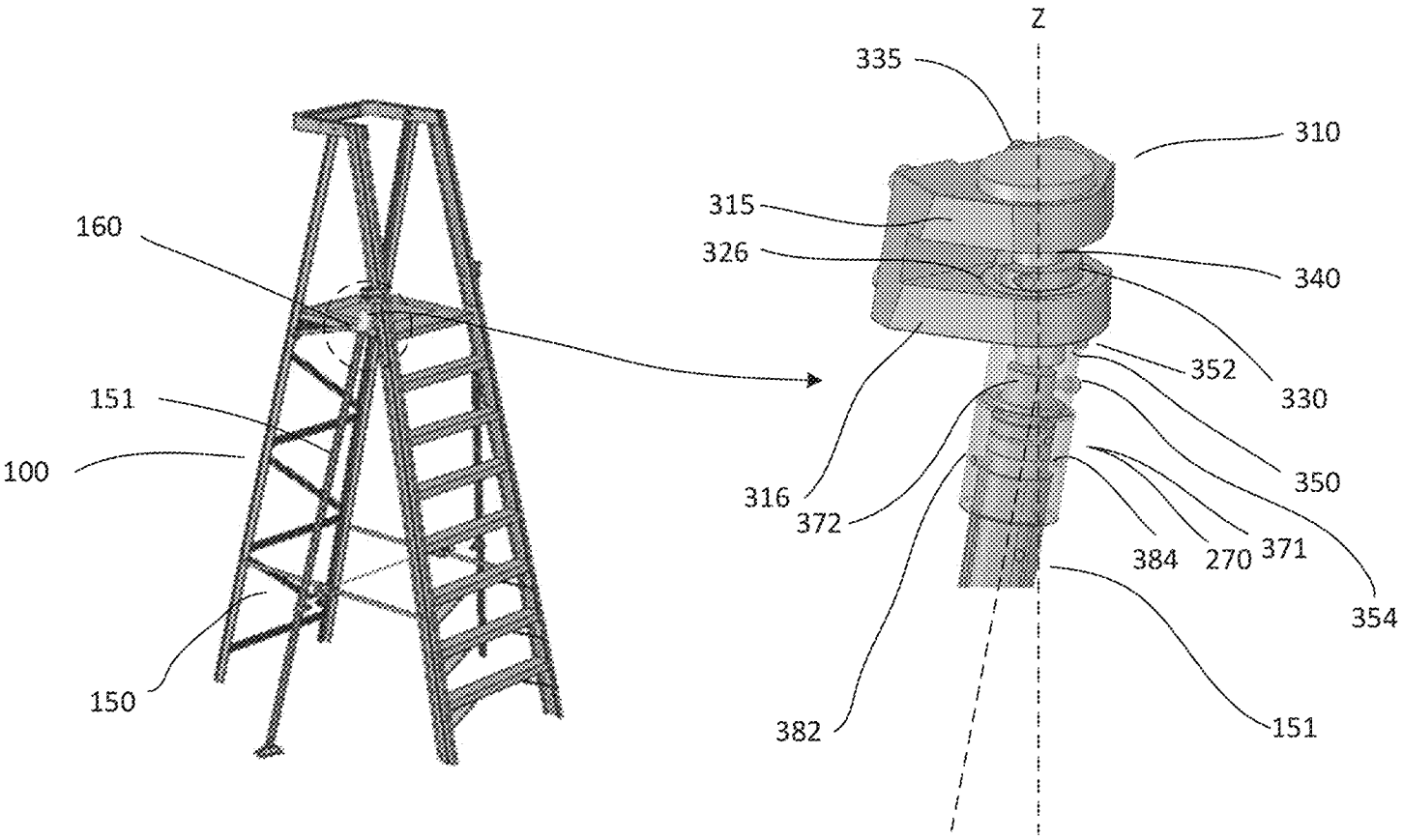
FIGS. 3*a-c* show various views of an embodiment of a outrigger coupling unit.

FIG. 3*a* shows an outrigger coupling unit 160 in greater detail. As discussed, the outrigger coupling unit couples an outrigger leg unit 150 to a side of the ladder 100. For example, the outrigger coupling unit is mounted onto a side of a front rail of a front rail unit. The coupling unit, in one embodiment, is a swivel joint coupling assembly. The coupling assembly includes a bearing housing 310. The bearing housing, for example, is mounted onto the ladder. The bearing housing includes an upper extension 315 and a lower extension 316. The upper extension includes an upper circular opening for accommodating an upper bearing and the lower extension includes a lower circular opening for accommodating a lower bearing 326. The bearings, for example, are ball bearings. Other types of bearings, such as sleeve bearings, may also be useful.

A bearing rod 340 is inserted through the bearings. The bearing rod, for example, extends from the upper housing extension, through the lower housing extension and ends below the bearing housing. A cap 335 is disposed on the top of the upper hosing extension to seal the upper bearing opening. A bearing collar 330 is fitted around the bearing shaft above the lower hosing extension. A joint block 350 is fitted to the bearing shaft which extends below the bearing housing. For example, the joint block is a tube through which the bearing shaft is inserted. The joint block may be fixed to the bearing shaft using a screw 352. Other techniques for fixing the joint block to the bearing shaft may also be useful. The bearing collar and the joint block maintain the bearing rod in position with respect to the bearing housing. The bearings enable the bearing rod, including the collar and joint block to rotate smoothly about the z-axis of the bearing rod.

A force sensor housing assembly 270, which includes a force sensor disposed in the sensor housing collar 371, is mated to the joint block 350. The force sensor housing, for example, includes a tube which houses the sensor components. One end of the sensor housing includes a housing extension. The housing extension is smaller in diameter than that of the housing and is inserted through the joint block. The force sensor housing is fixed to the joint block using, for example, a screw 354. Other techniques for fixing the sensor housing to the joint block may also be useful. At the other end of the force sensor housing is the outrigger member 151. The outrigger member is inserted into the force sensor housing and is fitted thereto by, for example, dowel pins 382 and 384. Other techniques for fixing the outrigger member to the housing may also be useful.

In one embodiment, the joint block is configured to join the force sensor housing and outrigger member at a designated angle with respect to the bearing rod. The designated angle, for example, is equal to the outrigger swing angle.

In one embodiment, the outrigger coupling unit and the outrigger unit are configured to produce a single fan-shaped folding/unfolding profile from the folded to unfolded position. For example, the outrigger unit is disposed at a designated angle with respect to the rotation of the swivel joint assembly. The designated angle, for example, results in the outrigger unit to be parallel to the front rail when the ladder is in its folded position and have an outrigger swing angle to provide lateral stability when the ladder is in its unfolded position.

Figure 3B:
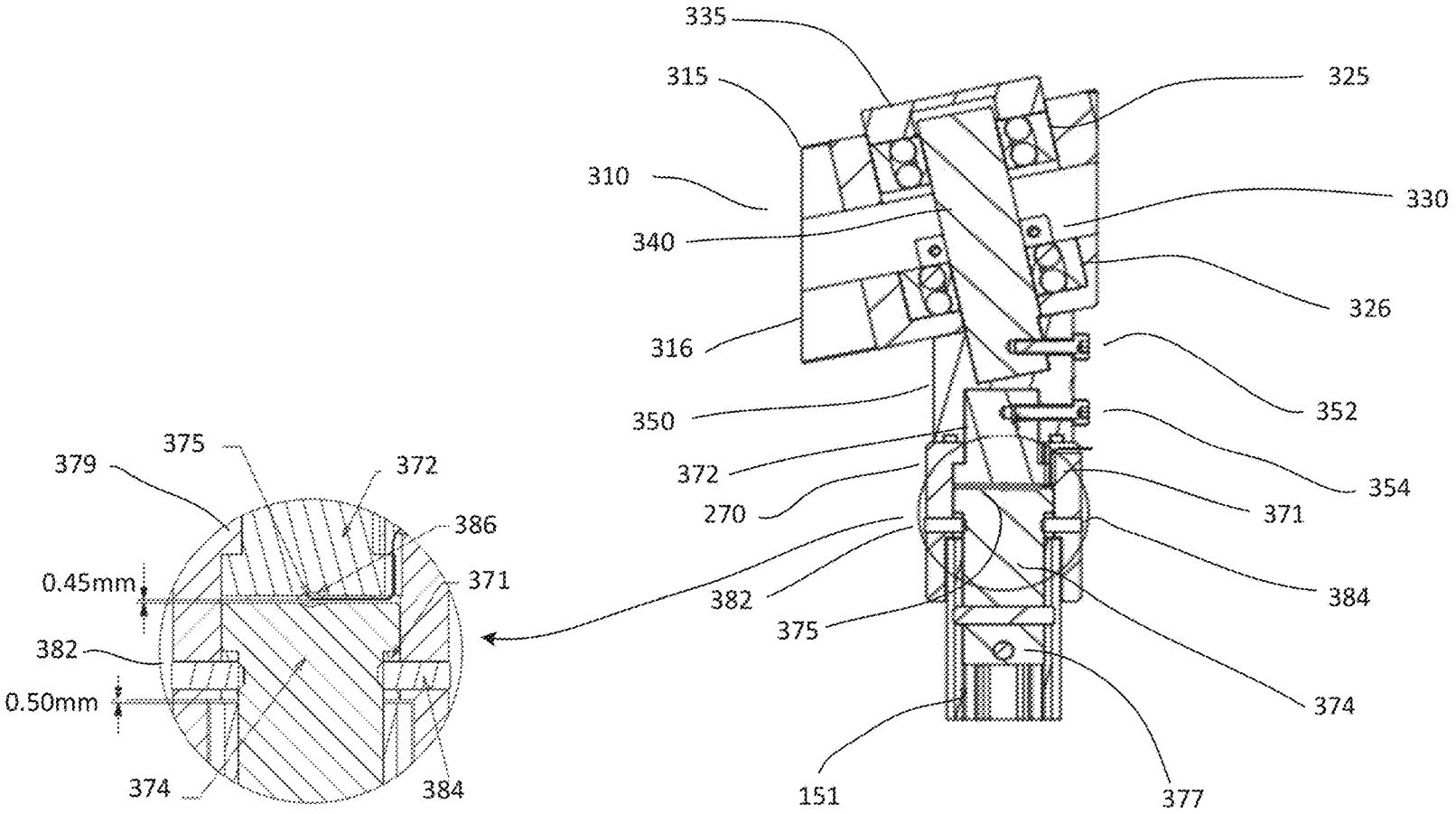

FIG. 3*b* shows a cross-sectional view of the outrigger coupling unit and illustrates the force sensor housing assembly in greater detail. The outrigger coupling unit is similar to that shown in FIG. 3*a*. Common elements may not be described or described in detail.

As shown, the bearing housing 310 accommodates upper and lower bearings 325 and 326 through which a bearing rod 340 is inserted. The collar 330 is mounted to the bearing rod above the lower bearings. The portion of the rod bearing which extends below the bearing housing is inserted into a joint block 350.

A force sensor housing assembly 270 is disposed below the joint block 350. The force sensor housing assembly includes a sensor housing collar 371 in which various components of the sensor assembly are disposed. As shown, a sensor holder 372 and a sensor trigger 374 are disposed within the sensor hosing collar 371. A top end of the housing collar includes a collar stop 379. The collar stop has an inner diameter that is smaller than the inner diameter of the rest of the collar. As for the sensor holder, it has a sensor or lower portion which has a larger outer diameter than an upper or non-sensor portion. The upper portion is configured to fit through the top of the collar while the lower portion with the larger diameter is maintained within the collar by the collar stop. The upper portion of the sensor holder is inserted into the joint block and fixed thereto by, for example, a screw 354.

As for the sensor trigger 374, it includes a sensor or upper portion and a non-sensor or lower portion. In one embodiment, the outer diameter of the sensor portion is larger than the outer diameter of the non-sensor portion. The non-sensor portion of the sensor trigger is inserted into the outrigger member 151. A screw 377 may be used to attach the outrigger member to the non-sensor portion of the sensor trigger. The sensor trigger and the outrigger member are configured to have a gap between the sensor portion and end of the outrigger member. The gap enables the sensor trigger to be locked in the housing collar by, for example, dowel pins 382 and 384.

In one embodiment, the surfaces of the sensor holder 372 and sensor trigger 374 include a dimple 386 to accommodate the force sensor 375. The gap between the surfaces has a tolerance of about 0.45 mm. As shown, the sensor trigger has space to move up and down within the housing collar according the force applied.

Figure 3C:
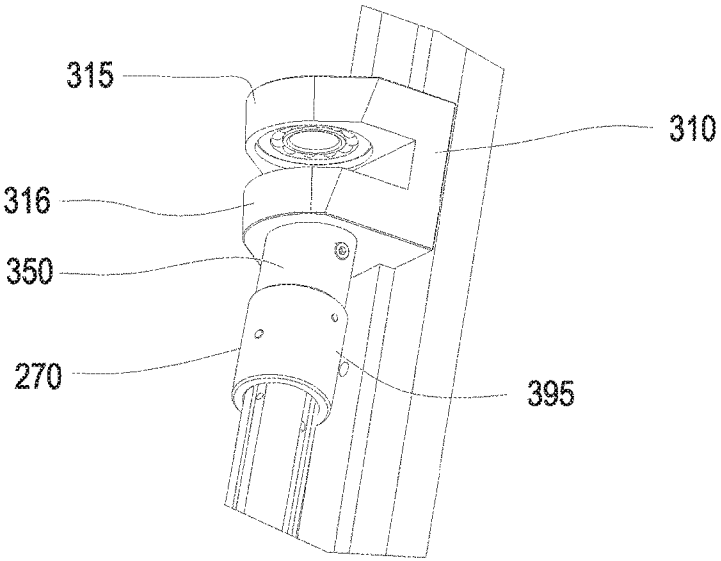

FIG. 3*c* shows an external view of an outrigger coupling unit 160. As shown, the bearing housing 310 includes upper and lower extensions 315 and 316. Below the bearing housing is the joint block 350 and the force sensor housing assembly 270. Wiring of the force sensor extends from the force sensor housing assembly to the electronic housing module (not shown).

Figure 4B:
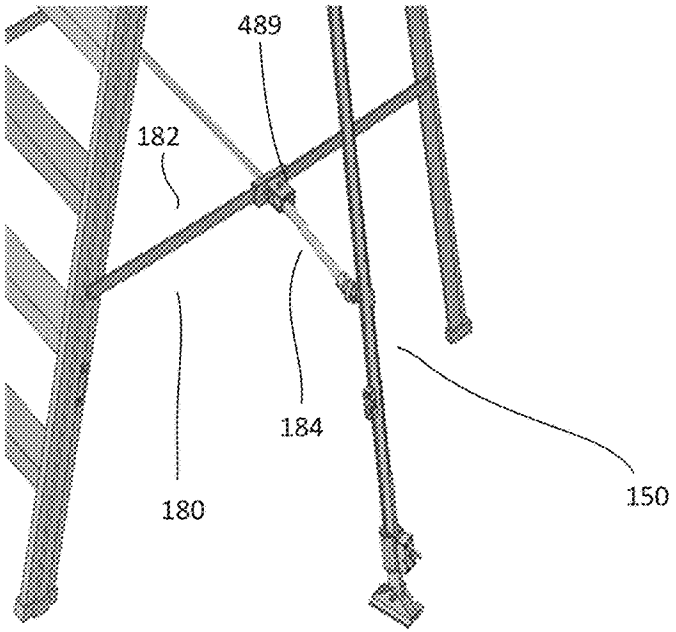
FIGS. 4*a-b* show folded and unfolded views of an embodiment of an outrigger unit.
Figure 4A:
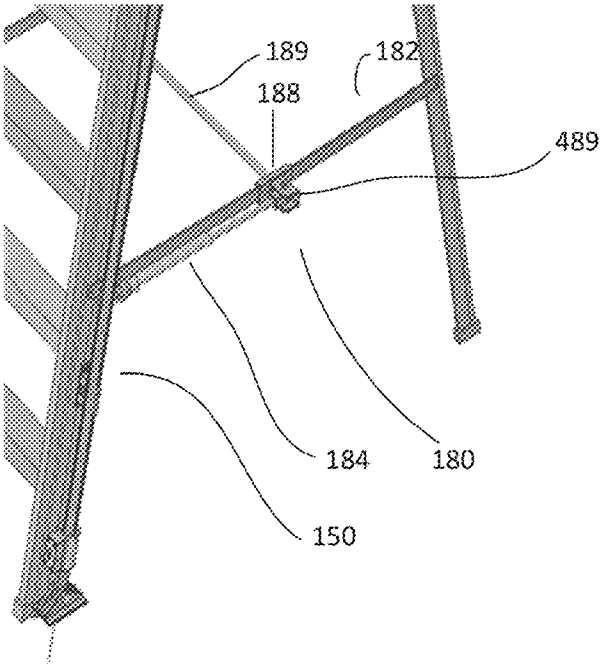

FIGS. 4*a-b* show details of folded and unfolded outrigger unit 150. As shown, the ladder is in its unfolded position. For example, the side brace module of the brace units 180 are deployed, unfolding the rail units to the maximum rail swing angle. The side brace modules prevent inadvertent folding of the ladder when the ladder is unfolded.

In FIG. 4*a*, outrigger unit 150 is in the folded position. For example, the outrigger unit is locked to the side of the front rail. When the ladder is unfolded, the extendable brace member 184 of the outrigger brace module can only rotate in a plane which is parallel to the plane of the ground due to the position of the rotatable outrigger brace coupler 489. For example, the outrigger brace coupler is a U-shaped bracket coupler which is positioned to only allow the outrigger brace member to rotate in a plane which is parallel to the ground.

In FIG. 4*b*, the outrigger unit is unfolded by swinging it out. The outrigger unit, when swung to its maximum unfolded swing angle, is rotated so the U-shaped bracket coupler forms an inverted U. This locks the outrigger unit in position. In addition, the pin is inserted into the extendable outrigger brace member to prevent it from extending or contracting. The length of the outrigger leg can be adjusted to ensure stability of the ladder.

Figure 4C:
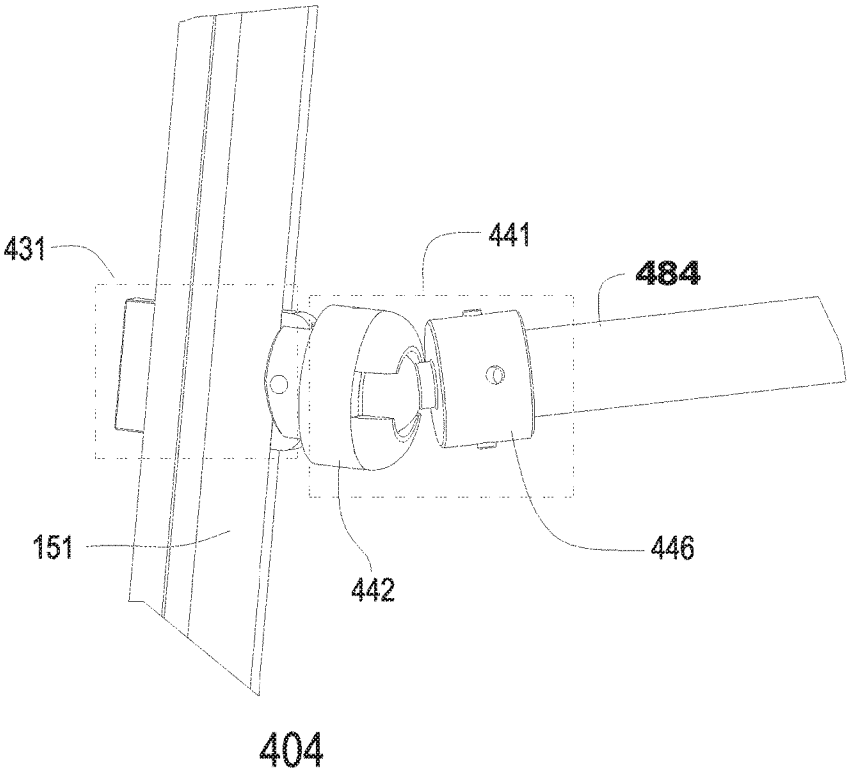
FIG. 4*c* shows an embodiment of a ball joint coupler.

FIG. 4*c* shows a ball joint coupler 404 for coupling the first outrigger brace sub-member 484 to the outrigger leg 151. A joint mount for the ball joint 431 is provided. The mount, for example, is mounted to the outrigger leg. A first end 442 of the ball joint 441 is then fixed to the joint mount. A second end 446 of the ball joint includes a receptacle for accommodating the first outrigger brace sub-member.

Figure 5B:
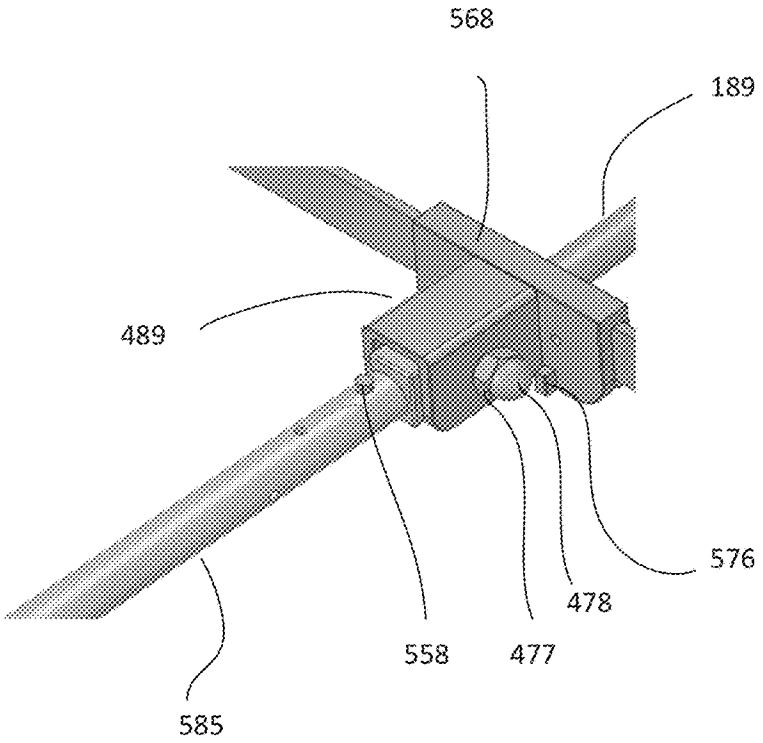
FIGS. 5*a-b* show locked and unlocked positions of an outrigger brace coupler.
Figure 5A:
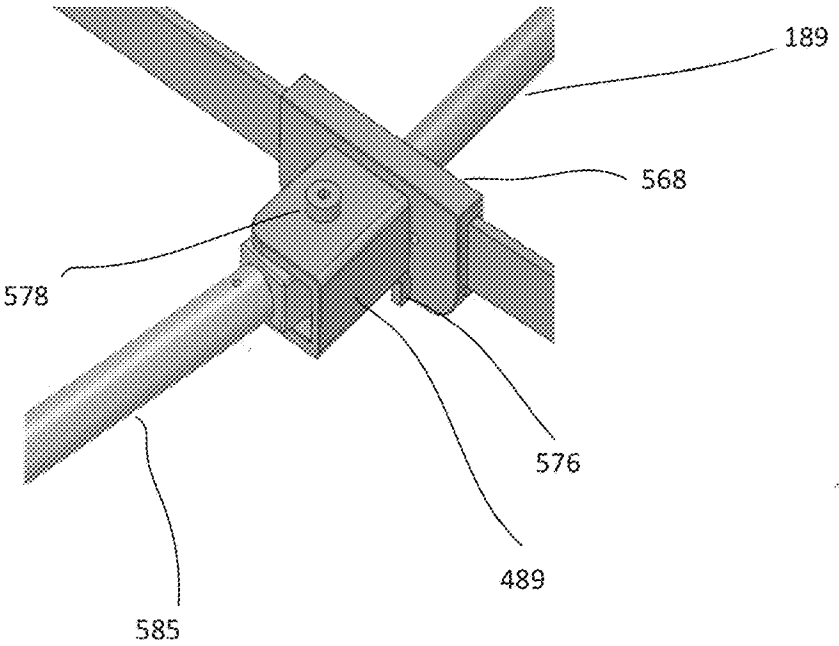

FIGS. 5*a-b* shows an outrigger brace coupler in locked and unlocked position when the outrigger unit is unfolded. As shown, an end of the second outrigger brace sub-member 585 of the extendable outrigger brace member is coupled to the rotatable U-shaped bracket 489 of outrigger brace coupler by a fastener 578. The fastener, for example, is a bolt 478 locked by a nut 477. The outrigger brace member rotates about the axis of the bolt. The rotation is limited by the side brace module and a bottom surface of the U-shaped bracket 489.

Referring to FIG. 5*a*, the U-shaped bracket is rotated to a reverse C position. The rotation of the outrigger brace coupler is stopped by a stopper 576 on the side brace coupler 568. In this position, the outrigger brace member rotates, for example, in a plane parallel to the ground. When the outrigger unit reaches its unfolded angle, the U-shaped bracket is rotated in a counter-clock wise direction until stopped by the stopper, as shown in FIG. 5*b*. This results in the bracket 489 having an upside-down U shape. In this position, the outrigger unit is locked in its maximum unfolded position since it cannot rotate in a plane parallel to the ground. Furthermore, a pin 558 is inserted into the extendable brace member, preventing it from inadvertently extending.

Figure 6A:
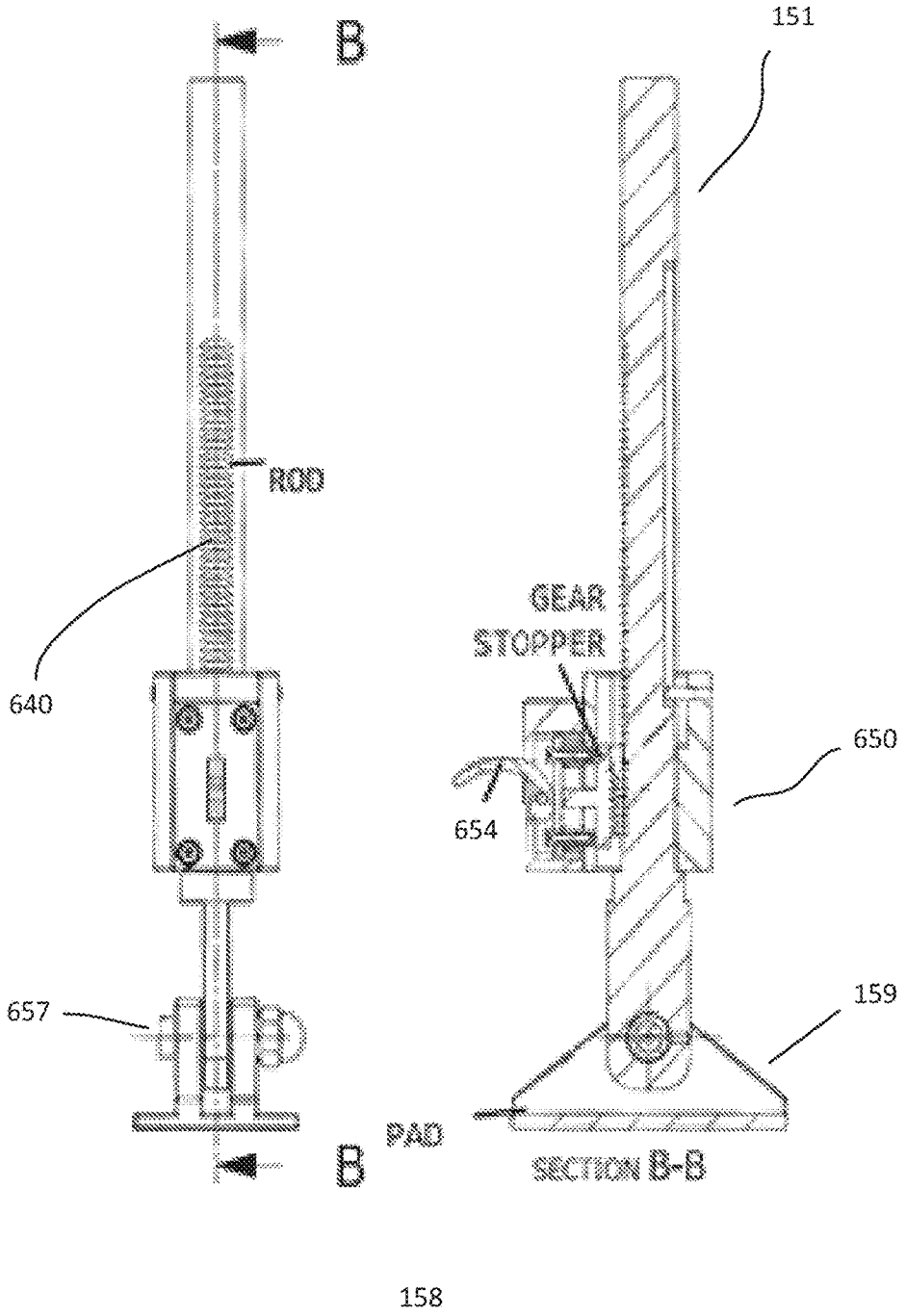
FIGS. 6*a-b* show different views of an adjustable foot module of an outrigger leg unit.
Figure 6B:
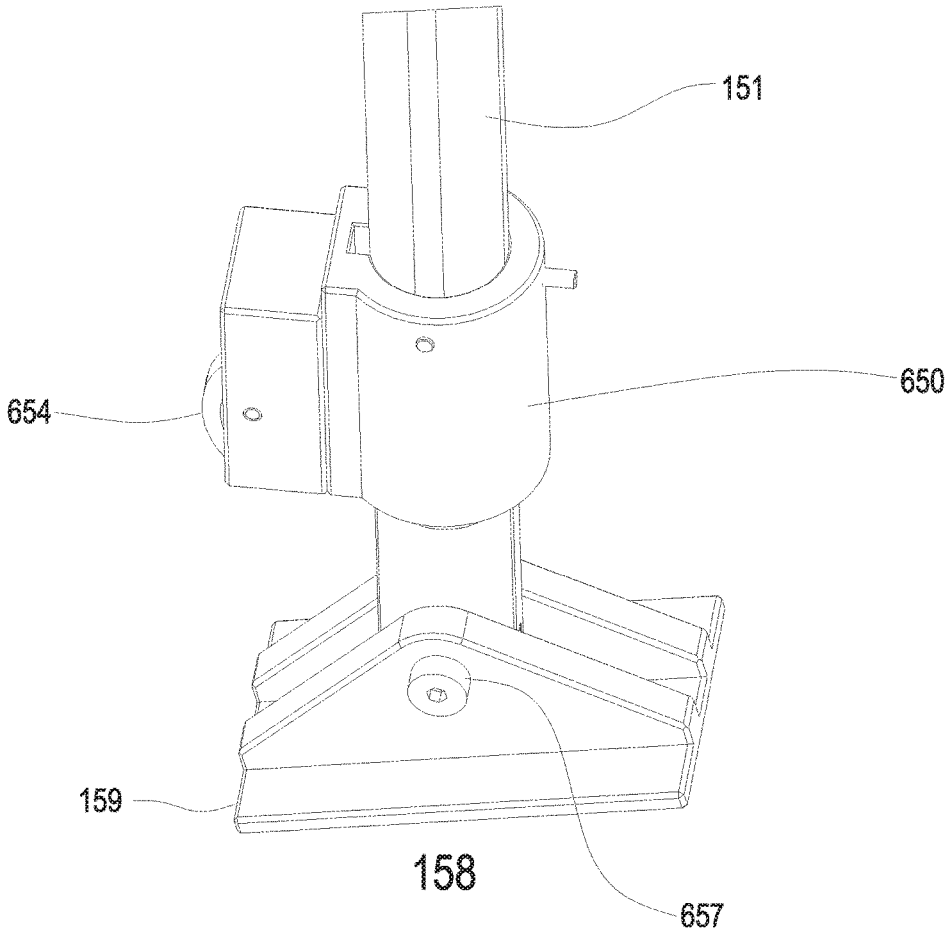

FIGS. 6*a-b* show different views of an adjustable foot module 158 of an outrigger leg unit. The adjustable foot module includes a tooth rod 640 with a foot end. The foot end includes a foot 159. The foot, for example, is attached to the foot end of the rod using a fastener 657. The fastener, for example, is a bolt and a nut. Other types of fasteners may also be useful. The foot pivots about the axis of the fastener. The bottom of the foot may be fitted with an anti-slip pad.

The outrigger leg unit includes an outrigger leg rod 151. A lock 650 is mounted near the end of the outrigger leg rod.

In one embodiment, the outrigger leg rod includes an opening where the lock is mounted. The lock includes a gear stopper which is configured to pass through the opening of the outrigger leg rod. A control lever 654 controls the engagement or disengagement of the gear stopper. For example, the gear stopper is disengaged when the tooth rod is inserted into the outrigger leg rod. Other techniques for engaging and disengaging the gear stopper may also be useful. When the gear stopped is disengaged, the rod slides freely in the outrigger leg rod. When the gear stopped is engaged, gear stopper mates with the tooth rod, preventing the ladder from slipping.

Figure 7:
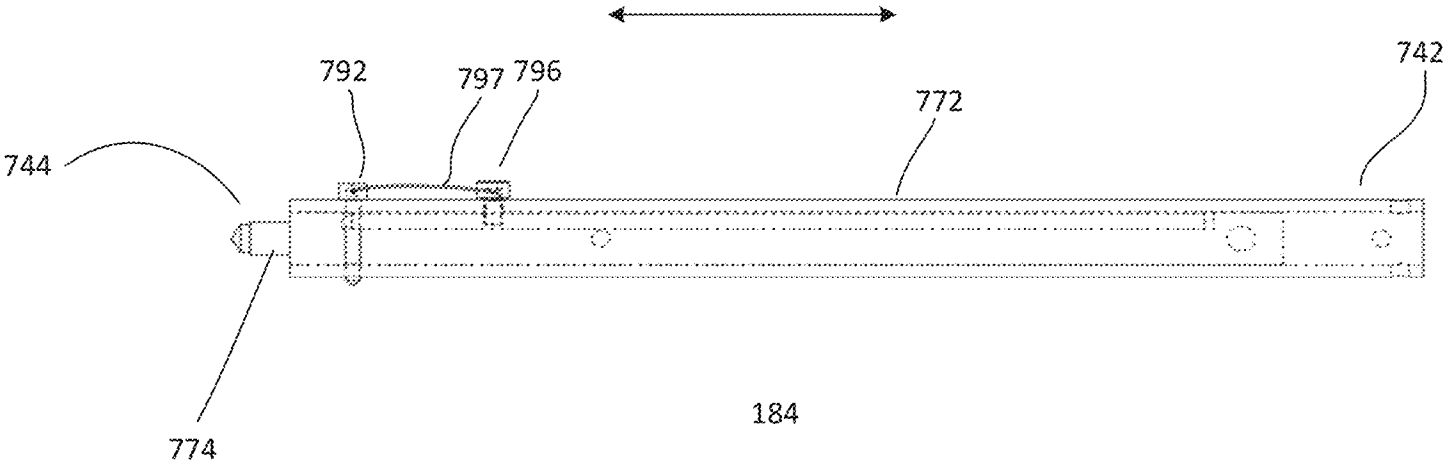
FIG. 7 shows an embodiment of an extendable outrigger brace member.

FIG. 7 shows an embodiment of an extendable outrigger brace member 184. The extendable brace member includes first and second outrigger brace sub-members 772 and 774. The first outrigger brace sub-member forms a first end 742 of the extendable brace member and the second outrigger brace sub-member forms a second end 744 of the extendable brace member. The first and second outrigger brace sub-members are slidably coupled. For example, the first outrigger brace sub-member is a hollow member in which the second outrigger brace sub-member is inserted. In one embodiment, the first outrigger brace sub-member is a hollow rod and the second outrigger brace sub-member is a rod. In one embodiment, the second outrigger brace sub-member is a solid rod. An inner diameter of the first outrigger brace sub-member is sufficient to accommodate the first outrigger brace sub-member. This allows the outrigger brace member to extend or retract along the direction indicated by the arrow.

The outrigger brace member includes a lock pin 792. The lock pin, when is inserted through the outrigger brace member, fixes the first outrigger sub-member in position. This prevents the outrigger member from inadvertently extending. To ensure that the pin does not get lost, it is attached to the outrigger brace member by a cable 797 which is attached to the outrigger brace member by, for example, a screw 796.

Figure 8A:
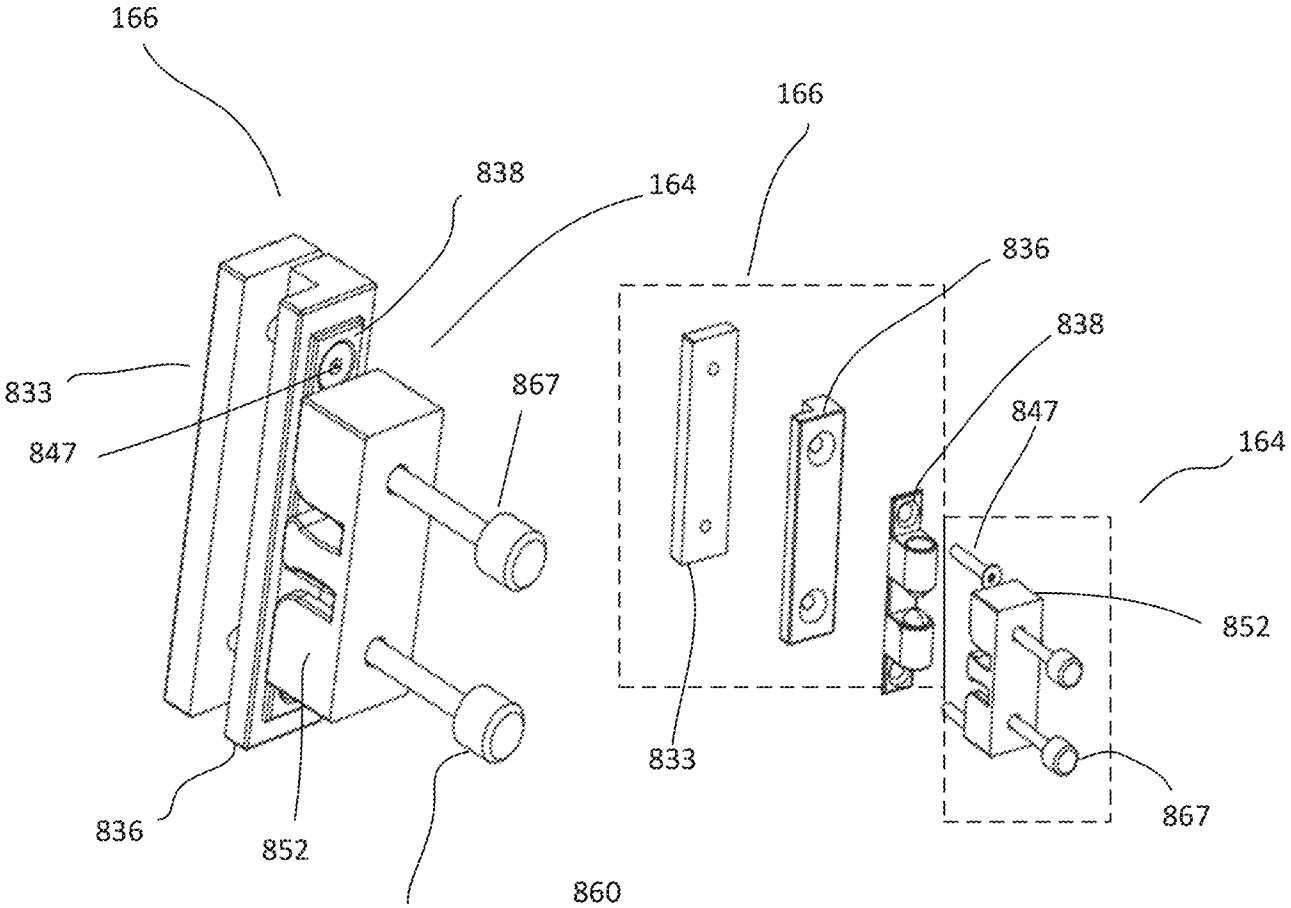
FIGS. 8*a-b* show various views of an embodiment of a storage lock for an outrigger unit.
Figure 8B:
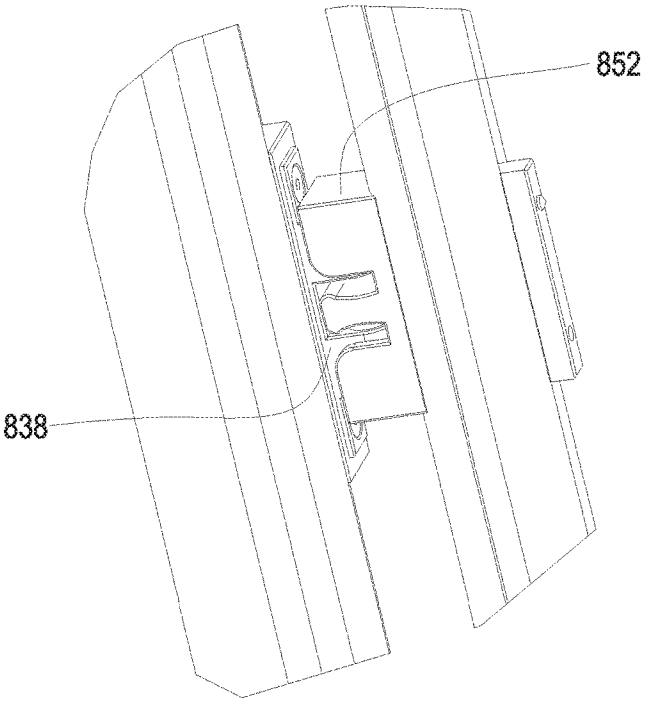

FIGS. 8*a-b* show various views of an embodiment of a storage lock 860 used in locking an outrigger leg unit to the side of the ladder when the ladder is in its folded position. The storage lock unit includes first and second storage lock sub-units 164 and 166. The first storage lock sub-unit is disposed on the outrigger unit while the second storage lock sub-unit is disposed on the front rail. The first and second storage lock sub-units are mated to lock the outrigger unit in position when it is in the folded position.

In one embodiment, the first sub-unit includes a lock adaptor 852. The lock adaptor may be mounted onto the outrigger leg using screws 867. As for the second sub-unit, it includes a lock receptacle 838 and first and second mounting plates 833 and 836. The first mounting plate is disposed on the inner side of the ladder while the second mounting plate is disposed on the outer side of the ladder. The lock receptacle is mounted onto the second mounting plate and is fixed to the ladder by screws 847. For example, the screws are screwed onto the first mounting plate on the opposite side of the ladder.

In one embodiment, the lock receptacle includes a spring-loaded ball bearing. The lock adaptor is configured to mate to the lock receptacle. The spring-loaded ball bearing at the lock receptacle ensures positive locking with sufficient holding strength to hold the outrigger unit to the side of the ladder frame.

Figure 9A:
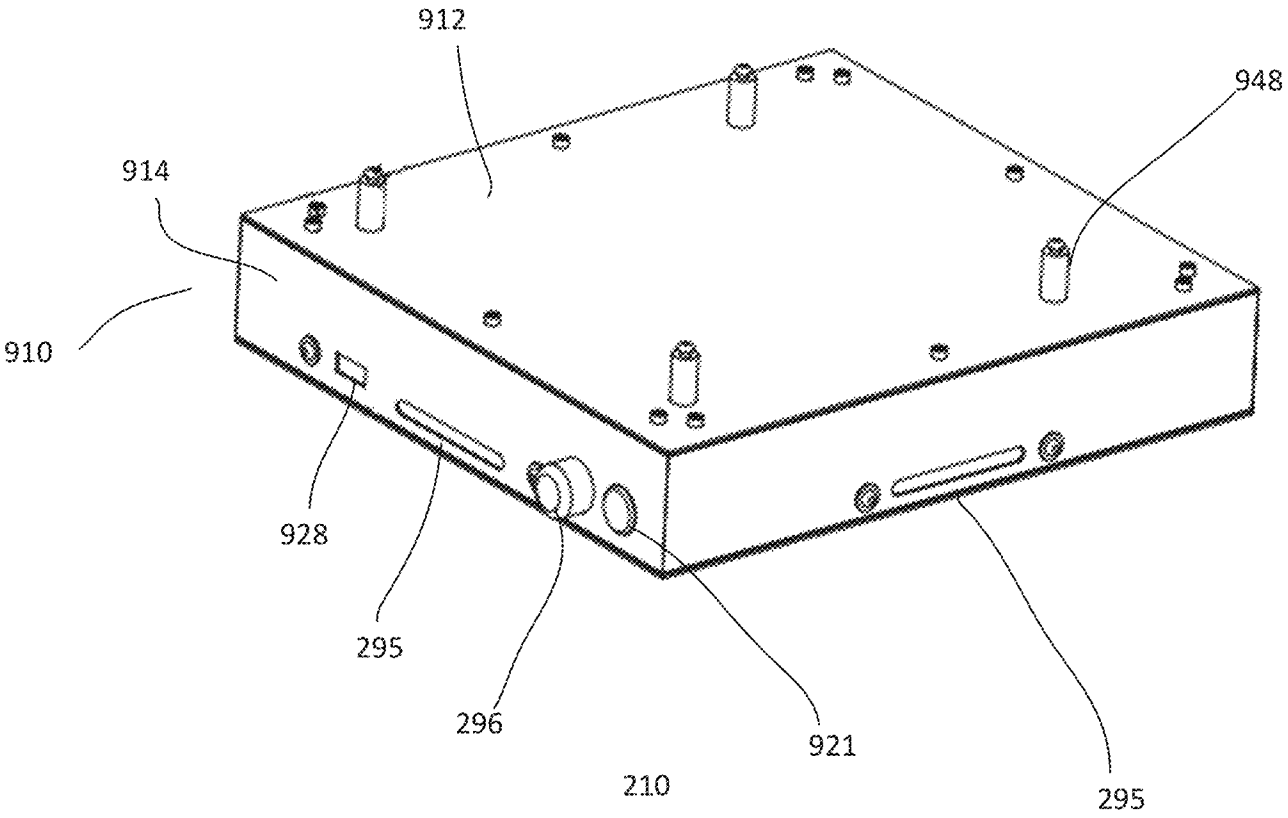
FIGS. 9*a-c* show different views of an embodiment of an electronic module housing.
Figure 9B:
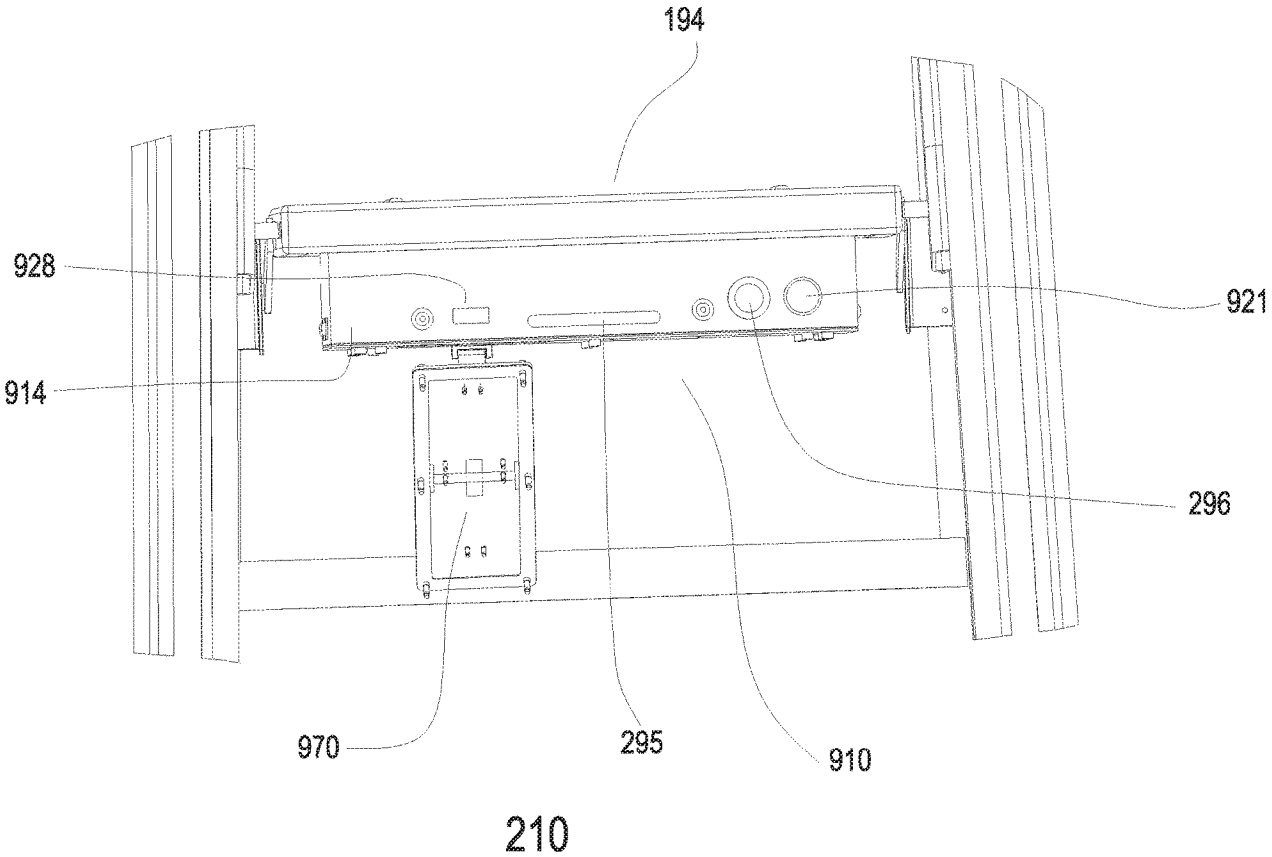

FIGS. 9*a-b* show various views of an embodiment of an electronic module housing 210. As shown, the module housing includes a case 910. The case, for example, is a rectangular metallic case having side surfaces 914 and a top surface 912. The case, for example, is a waterproof case to prevent weather-related damages of the internal electronic components. In one embodiment, the load cells, IMU and processor and warning unit are integrated into the housing. The electronic system, for example, may operate on battery which is disposed within the case. The battery, for example, may be a rechargeable battery with sufficient battery life. In addition, a charging port may be provided to enable charging of the battery by a charger 970 as well as operating of the system in charge mode. The charger may be mounted on the back rail unit of the ladder for convenience. The warning system includes lights 295 disposed on all sides of the case and a waterproof buzzer 296 disposed on a front side of the case. The front side of the case may also include a battery indicator 928 and power-on switch 921. Disposed on the top surface of the case are mounts 948 for mounting onto the platform 194 or on the ladder limiting panel.

Figure 9C:
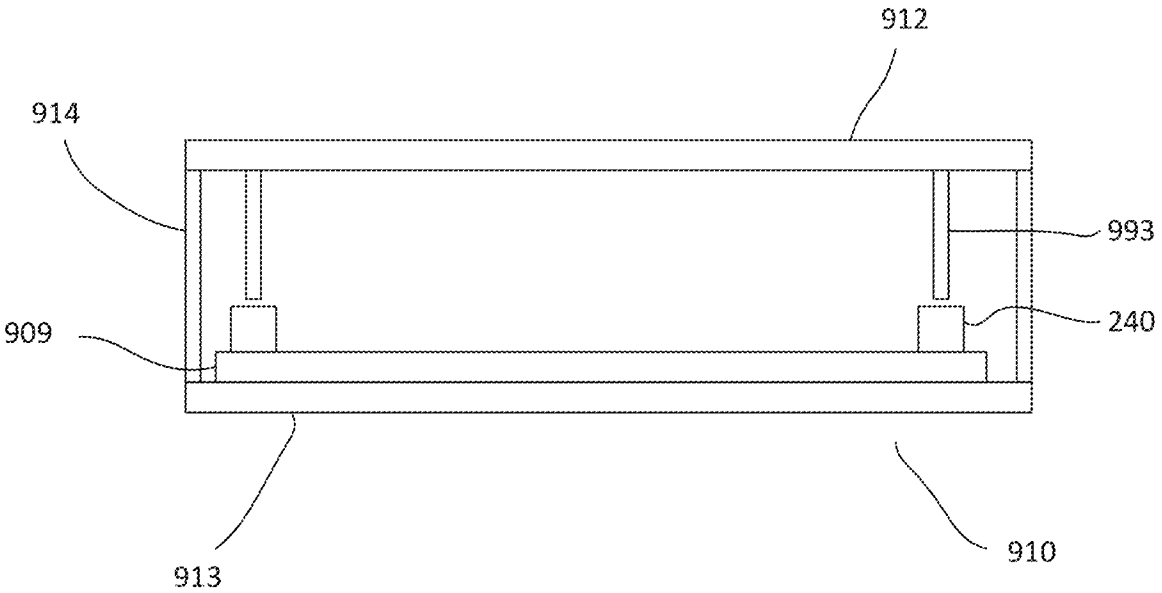

FIG. 9*c* shows cross-sectional view of a module housing 210 illustrating load cell arrangement. As shown, the case 910 include a top surface 912, a bottom surface 913 and side surfaces 914. Disposed on the bottom surface of the case is a circuit board 909. The circuit board includes a plurality of load cells 240. For example, in the case of a rectangular case, four load cells may be employed and may be arranged near the corner of the case. Mounted on the top surface of the case are sensor triggers 993. The case is strained by the load on the platform and the sensor triggers contacts the load cells. The information measured from the load cells reflects the load on the platform.

Figure 10:
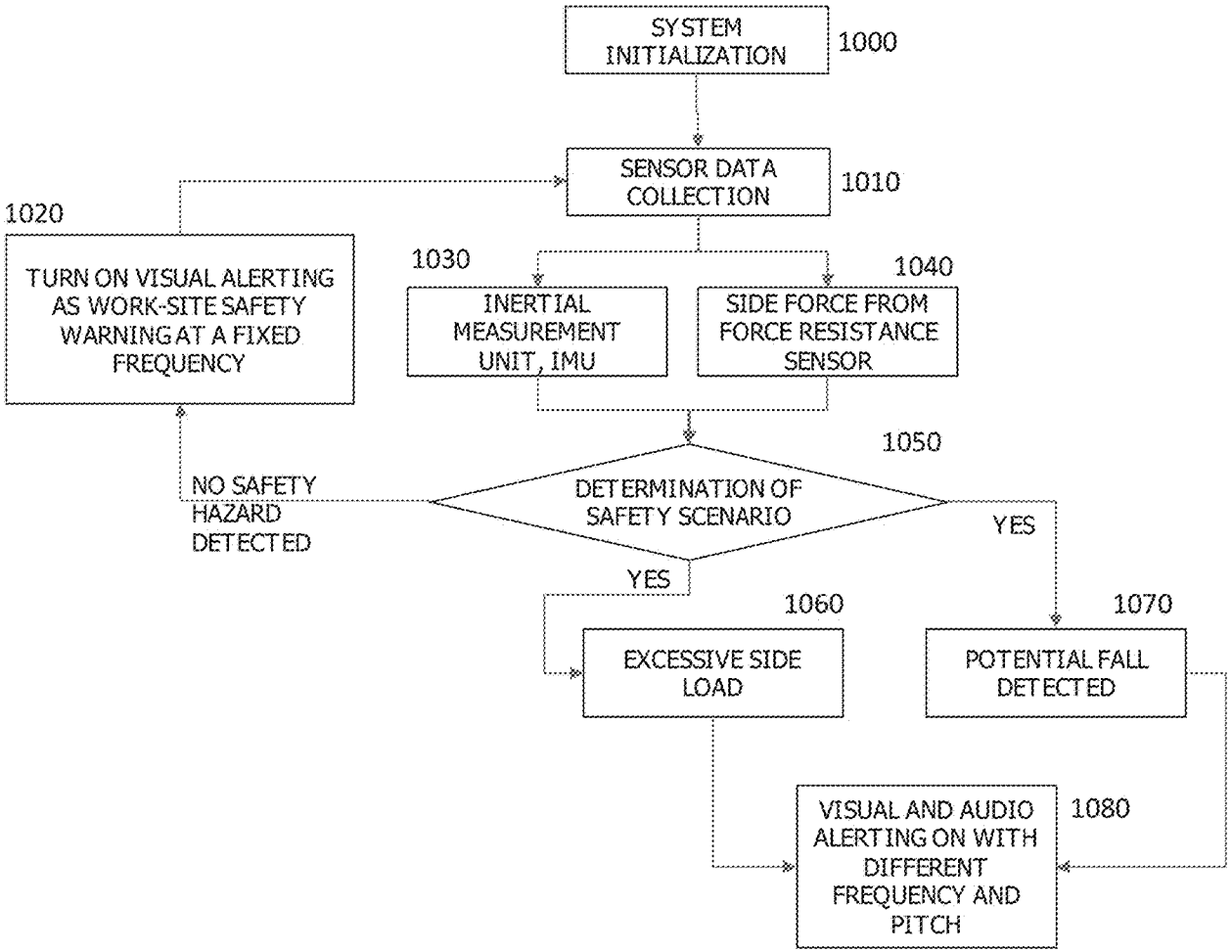
FIG. 10 shows a process for monitoring and alerting using the processing unit.

FIG. 10 shows a process performed by the electronic system of the ladder. At 1000, the system is initiated. For example, once the ladder is unfolded and the outrigger units are unfolded, the electronic system is initialized. Different sensors of the sensor network and the processor unit start operating when the system is initialized. At 1010, sensor data are collected by sensors of the sensor system. For example, inertial measurement data are collected by the IMU at 1030 and side force data on the outrigger units are collected from the force resistance sensors at 1040. The processor processes, at 1050 to predict or anticipate a problem. At the initial phase, no safety hazard should be detected. The electronic system switches on the visual work-site safety warning system at 1020. For example, warning lights on the module housing switches on at a fixed frequency. The system continues to collect data at 1010.

In the event that at 1050, a safety hazard is detected, such as excessive side load is detected from the force sensors at 1060, or potential fall is predicted at 1070, the audio alarm 291 and the visual alarm 292 are set to alert the user as well as people in the vicinity of the potential hazard. Different pitch and/or frequency may be used to differentiate different types of hazards.

In the case that load sensors are employed, such as in the platform ladder, the system also collects load data and determines if the load exceeds the set limits. If the load exceeds the set limit, the audio alarm 291 and the visual alarm 292 are similarly set to alert the user as well as people in the vicinity of the potential hazard at 1080.

As described, the electrical system of the ladder serves as a warning system that a potential accident may occur prior to its occurrence. For example, information is processed to anticipate whether a fall may occur using predictive mathematical formulation, such as Kalman filtering or LQE. This improves safety by providing a warning when a potential fall is predicted or anticipated before it occurs.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

The invention claimed is:

1. A ladder comprising:

a front rail unit having a plurality of steps and a rear rail unit;

a right outrigger leg unit coupled to a right side of the ladder, wherein the right outrigger leg unit is configured to provide side support on the right side of the ladder;

a left outrigger leg unit coupled to a left side of the ladder, wherein the left outrigger leg unit is configured to provide side support on the left side of the ladder; and an electronic system which enhances safe operation of the ladder, the electronic system comprises:

a sensor network having a plurality of sensors for sensing force asserted on the outrigger leg units, an angle of inclination and acceleration of the ladder; and a processing unit coupled to the sensor network, the processing unit processes information from the sensor network and generates a warning alert of potential unsafe use of the ladder;

a right swivel joint for coupling the right outrigger leg unit to the right side of the ladder, wherein the right swivel joint comprises right force sensors of the sensor network to measure force asserted on the right outrigger leg unit;

a left swivel joint for coupling the left outrigger leg unit to the left side of the ladder, wherein the left swivel joint comprises left force sensors of the sensor network to measure force asserted on the left outrigger leg unit.

2. The ladder of claim 1 wherein the swivel joints comprise bearing housings to accommodate and freely rotate bearing rods of the outrigger leg units about a vertical axis which is perpendicular to a ground.

3. The ladder of claim 1 wherein the ladder comprises an A-frame ladder, wherein the A-frame ladder includes an A limiting panel which serves to inform a user of a maximum height of ladder defined by a step below the A-limiting panel.

4. The ladder of claim 1 wherein the ladder comprises an A-frame platform ladder having an A-frame platform, wherein the A-frame platform ladder includes an electronic housing module which is mounted on a bottom side of the A-frame platform; and the sensor network of the electronic system further comprises load sensors housed in the electronic housing module, the load sensors are configured to measure a load asserted on the platform of the A-frame platform ladder.

5. The ladder of claim 1 wherein the ladder comprises an A-frame ladder.

6. The ladder of claim 1 wherein the ladder comprises an A-frame platform ladder.

7. The ladder of claim 1 wherein:

the right outrigger leg unit is disposed adjacent and parallel to the right side of the ladder in the folded position;

in the unfolded position, the right outrigger leg unit is disposed on the right side of the ladder to provide side support on the right side of the ladder when unfolded;

the left outrigger leg unit is disposed adjacent and parallel to the left side of the ladder in the folded position; and in the unfolded position, the left outrigger leg unit is disposed on the left side of the ladder to provide side support on the left side of the ladder when unfolded.

8. The ladder of claim 1 wherein:

the right swivel joint further comprises right bearings to rotate the right bearing rod, wherein the right bearing rod rotates about a right swivel axis from which a right swivel angle is measured; and the left swivel joint further comprises left bearings to rotate the left bearing rod, wherein the left bearing rod rotates about a left swivel axis from which a left swivel angle is measured.

9. The ladder of claim 1 comprises:

the right swivel joint for coupling the right outrigger leg unit to the right side of the front rail unit; and the left swivel joint for coupling the left outrigger leg unit to the left side of the front rail unit.

10. The ladder of claim 8 wherein:

the right swivel joint further comprises a right joint assembly, the right joint assembly couples the right bearing rod to the right outrigger leg unit; and the left swivel joint further comprises a left joint assembly, the left joint assembly couples the left bearing rod to the left outrigger leg unit.

11. The ladder of claim 10 wherein the joint assembly couples the bearing rod at a dedicated outrigger swing angle.

12. The ladder of claim 11 wherein the dedicated outrigger swing angle is selected to provide lateral stability in the unfolded position.

13. The ladder of claim 1 wherein:

the right outrigger leg unit includes a right outrigger leg having an adjustable right foot for adjusting a length of the right outrigger leg; and the left outrigger leg unit includes a left outrigger leg having an adjustable left foot for adjusting a length of the left outrigger leg.

14. The ladder of claim 1 comprises:

an electronic housing module which houses the processing unit and an inertial measurement unit (IMU), the IMU measures the angle of inclination and acceleration of the ladder in 3 axes.

* * * * *